US008431012B2

(12) United States Patent
Sirota et al.

(10) Patent No.: US 8,431,012 B2
(45) Date of Patent: Apr. 30, 2013

(54) LUBRICATING BASE OIL

(75) Inventors: Eric B. Sirota, Flemington, NJ (US); Roland Saeger, Runnemede, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 87 days.

(21) Appl. No.: 12/587,711

(22) Filed: Oct. 13, 2009

(65) Prior Publication Data

US 2011/0087057 A1 Apr. 14, 2011

(51) Int. Cl.
*C10M 105/04* (2006.01)
*C10M 107/02* (2006.01)

(52) U.S. Cl.
USPC ..... 208/18; 208/950; 508/110; 585/7; 585/13

(58) Field of Classification Search ..... 208/18, 208/950; 518/700
See application file for complete search history.

(56) References Cited

U.S. PATENT DOCUMENTS

| | | | | |
|---|---|---|---|---|
| 3,005,768 | A | 10/1961 | Burke | |
| 4,397,827 | A | 8/1983 | Chu | |
| 4,474,618 | A | 10/1984 | Yen et al. | |
| 4,568,663 | A | 2/1986 | Mauldin | |
| 4,585,747 | A | 4/1986 | Valyocsik | |
| 4,627,901 | A | 12/1986 | Ryan et al. | |
| 5,075,269 | A | 12/1991 | Degnan et al. | |
| 5,098,684 | A | 3/1992 | Kresge et al. | |
| 5,227,353 | A | 7/1993 | Apelian et al. | |
| 5,348,982 | A | 9/1994 | Herbolzheimer et al. | |
| 5,545,674 | A | 8/1996 | Behrmann et al. | |
| 5,573,657 | A | 11/1996 | Degnan et al. | |
| 5,951,847 | A | 9/1999 | Grandvallet et al. | |
| 6,051,129 | A | 4/2000 | Harris et al. | |
| 6,468,417 | B1 | 10/2002 | Biscardi et al. | |
| 6,468,418 | B1 | 10/2002 | Biscardi et al. | |
| 6,579,441 | B1 | 6/2003 | Biscardi et al. | |
| 6,699,385 | B2 * | 3/2004 | Miller | 208/27 |
| 6,846,778 | B2 * | 1/2005 | Johnson et al. | 508/110 |
| 6,962,651 | B2 * | 11/2005 | Miller et al. | 208/95 |
| 7,198,710 | B2 * | 4/2007 | Miller et al. | 208/78 |
| 7,241,375 | B2 * | 7/2007 | Johnson et al. | 208/18 |
| 7,378,452 | B2 * | 5/2008 | Long et al. | 518/700 |
| 7,465,389 | B2 * | 12/2008 | Sirota et al. | 208/332 |
| 2004/0256287 | A1 * | 12/2004 | Miller et al. | 208/58 |
| 2006/0006103 | A1 | 1/2006 | Sirota et al. | |
| 2008/0083648 | A1 * | 4/2008 | Bishop et al. | 208/28 |
| 2009/0163391 | A1 | 6/2009 | Zakarian et al. | |
| 2009/0186786 | A1 * | 7/2009 | Poirier et al. | 508/287 |
| 2011/0083995 | A1 * | 4/2011 | Gleeson et al. | 208/38 |

FOREIGN PATENT DOCUMENTS

| | | | |
|---|---|---|---|
| EP | 0142317 | A2 | 5/1985 |
| EP | 1550709 | A1 | 7/2005 |
| WO | 2004033607 | A1 | 4/2004 |
| WO | 2009064494 | A1 | 5/2009 |

* cited by examiner

*Primary Examiner* — Ellen McAvoy
(74) *Attorney, Agent, or Firm* — Liza Montalvo; David Weisberg

(57) ABSTRACT

The present invention is directed to a heavy hydrocarbon composition useful as a heavy lubricant oil base stock and to a heavy lubricant composition derived from the heavy lubricant oil base stock that remains clear and bright even after being cooled to room temperature and stored for an extended period of time.

10 Claims, 3 Drawing Sheets

LUBRICATING BASE OIL

FIELD OF THE INVENTION

This invention relates to lubricating base oils. More particularly, this invention relates to lubricating base oils that remain clear and bright after left standing at ambient conditions.

BACKGROUND OF THE INVENTION

The problems associated with wax in lubricating oils are very well known. In the distillation of crude oil, a proportion of wax is present in cuts taken in the lubricating oil range. Some of the wax remains dissolved in the oil, whereas other fractions form a haze as the oil fraction ages at ambient temperatures. The appearance of haze affects the aesthetics and the economics of petroleum products. Products that are clear and bright are more highly valued than those that are hazy. The clear and bright test is a qualitative test for determining free water and particulate matter in oil and is, therefore, subject to human interpretation.

Haze manifests itself as a milky or cloudy appearance in the oil and is often caused by wax or by both wax and tiny water droplets being present in the oil. Typically a minimum amount of wax will cause some oils to look hazy. The haze precursors are wax type molecules which are more difficult to remove than are the waxes typically associated with pour point and cloud point.

In preparing a petroleum product such as a finished heavy lubricant base stock, the base stock will be subjected to a dehazing step to improve its appearance. Dehazing is typically achieved by either solvent or catalytic dewaxing to remove those constituents that result in haziness. Solvent dewaxing physically removes wax from oil as a solid at low temperature using a solvent. Whereas, catalytic dewaxing uses a catalyst that converts long chain normal or slightly branched long chain hydrocarbon (wax) into shorter chain hydrocarbon by cracking/fragmentation, to thereby reduce pour point and cloud point (both of which are measured at low temperature). However, the haze precursors of interest do not necessarily respond to conventional wax removal techniques such as solvent or catalytic dewaxing or would do so only with severe loss in yield of the desired product.

U.S. Pat. No. 6,579,441 is directed to a base oil feed having a reduced tendency to form haze at ambient or sub-ambient temperatures. The haze forming tendency of the oil is determined by measuring NTU. NTU has long been used to measure turbidity in liquids such as water. While U.S. Pat. No. 6,579,441 teaches a base oil having an NTU value of less than 2 with a reduced tendency to develop haze, the base oil does not remain clear and bright after being left standing at ambient conditions for an extended period of time.

Despite the advances in lubricant oil formulation technology, experience has shown that a lubricant base oil having a satisfactory cloud point, e.g., 5° C. or even lower, and pour point and that is clear and bright right after it is cooled to room temperature, may upon storage develop a haze. This phenomenon is referred to herein as delayed onset haze formation.

Thus, there remains a need for lubricant base oils that remain clear and bright even after being cooled to room temperature and stored for a period of time as long as several months, e.g., up to six months. The present invention provides for a heavy hydrocarbon composition having high viscosity, low pour and cloud points and a haze disappearance temperature of 20° C. (68° F.) or less, allowing the composition to remain clear and bright at room temperature.

SUMMARY OF THE INVENTION

The present invention is directed to a heavy hydrocarbon composition useful as a heavy lubricant oil base stock and to a heavy lubricant composition derived from the heavy lubricant oil base stock that remains clear and bright even after being cooled to room temperature and stored for an extended period of time, e.g., at least 14 days.

The heavy lubricant base stock composition is characterized by at least greater than 50 wt % iso-paraffinic molecules based on the total weight of the composition, preferably at least greater than 80 wt %, most preferably at least greater than 90 wt %, a distribution of molecules wherein at least 75 wt % of the molecules have a carbon number greater than $C_{25}$, preferably at least 50 wt % greater than $C_{40}$, having at least 10 wt %, preferably at least 50 wt %, of the total base stock boiling above 537° C. (1000° F.), a kinematic viscosity at 100° C. of at least 8 cSt, preferably at least 12 cSt, more preferably at least 15 cSt and a haze disappearance temperature of 20° C. (68° F.) or less, preferably 15° C. (59° F.) or less. The temperature at which haze is not visible and the petroleum product is judged to be clear and bright is referred to herein as the haze disappearance temperature. The base stock is typically a liquid at the temperature and pressure conditions of use and typically, but not always, at ambient conditions of 25° C. (77° F.) and one atmosphere (101 kPa) pressure.

In another embodiment, the invention is directed to a heavy lubricant composition comprising the heavy lubricant oil base stock of the present invention and at least one lubricant additive.

Other objects and advantages of the present invention will become apparent from the detailed description that follows.

DETAILED DESCRIPTION

Figure 1:
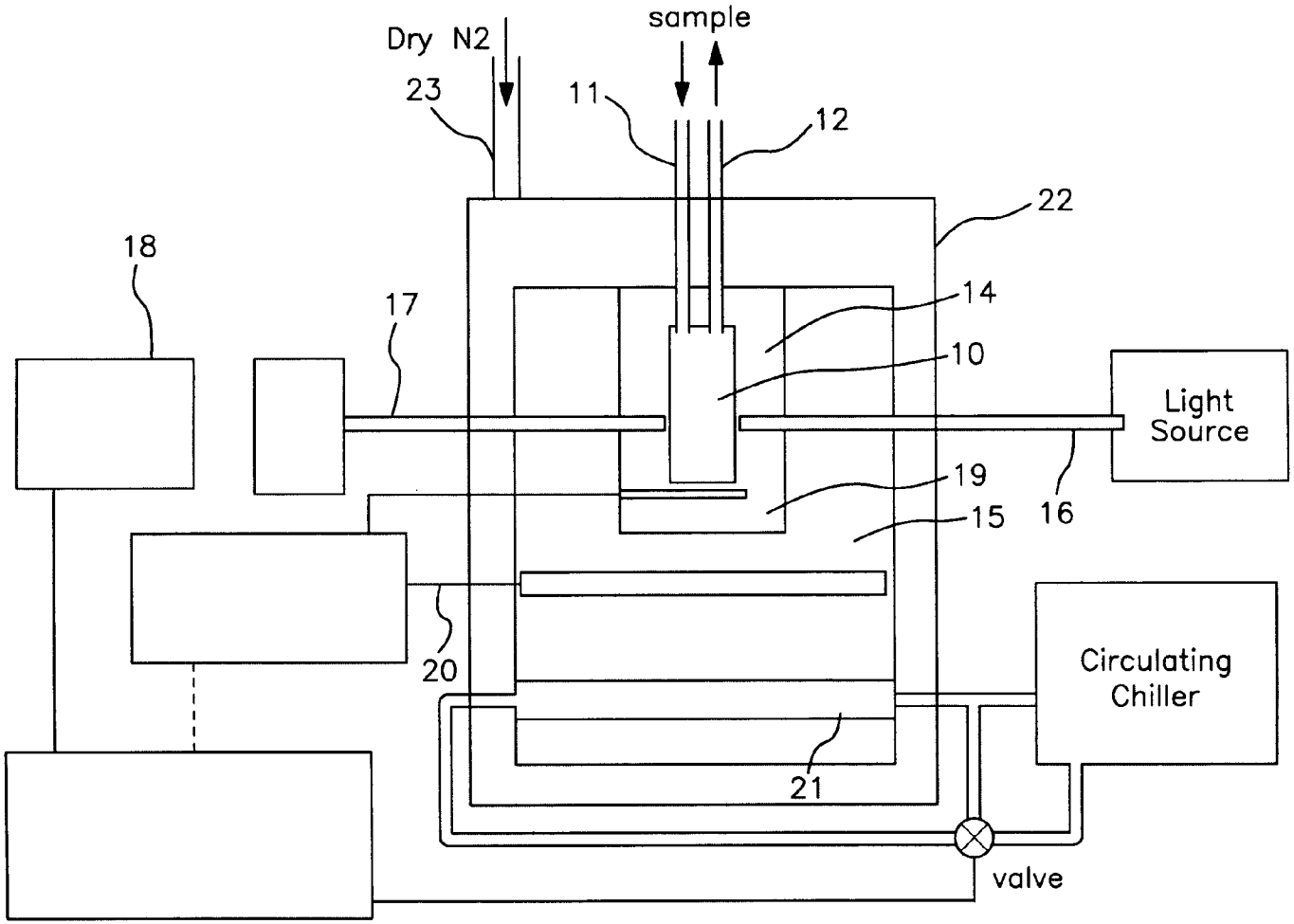
FIG. 1 is a schematic illustration of an optical phase behavior unit used to measure haze disappearance temperature.

The hydrocarbon or heavy lubricant oil base stock composition of the invention are derived from natural or synthetic dewaxed oils. The waxy feed from which the natural or synthetic dewaxed oils is produced will have a cloud point (ASTM D-5773) of about 5 to −10° C. and will have an initial boiling point in the range of from about $C_5^+$ (or about 38° C. (100° F.)) up to about 288 to 388° C. (550 to 730° F.) and preferably continuously boils up to an end point of at least 566° C. (1050° F.). Preferably, the base stock is derived from Gas to Liquids (GTL) heavy wax isomerate, prepared from a full range Fischer-Tropsch wax, 177 to 704° C. (350° F. to 1300° F.) (and higher) boiling point, by at least two stages of catalytic hydroisomerization, followed by distillation and then dehazing. The heavy lubricant base stock composition can have at least greater than 50 wt % iso-paraffinic molecules based on the total weight of the composition, preferably at least greater than 80 wt %, most preferably at least greater than 90 wt %, a distribution of molecules wherein at least 75 wt % of the molecules have a carbon number greater than $C_{25}$, preferably at least 50 wt % greater than $C_{40}$, at least 10 wt %, preferably at least 50 wt %, of the total base stock boiling above 537° C. (1000° F.), kinematic viscosities at 100° C. of at least 8 cSt, preferably at least 12 cSt, more preferably at least 15 cSt, and a $T_5$ of about 454 to 538° C. (850 to 1000° F.) and a $T_{95}$ above 538° C. (1000° F.), preferably above 566° C. (1050° F.). The base stock composition comprises at least 95 wt % paraffin molecules, of which at least 90 wt % are isoparaffins and is typically a liquid at the temperature and pressure conditions of use and typically, but not always, at ambient conditions of 24° C. (75° F.) and one atmosphere (101 kPa) pressure. The heavy lubricant base stock composition will have a haze disappearance temperature (HDT) of 20° C. (68° F.) or less, preferably 15° C. (59° F.) or less.

GTL base oil comprise at least one base stock obtained from a GTL process via one or more synthesis, combination, transformation, rearrangement, and/or degradation deconstructive process from gaseous carbon containing compounds. Preferably, the GTL base stock is derived from the Fischer-Trospch (FT) synthesis process wherein a synthesis gas comprising a mixture of $H_2$ and CO is catalytically converted to lower boiling materials by hydroisomerisation and/or dewaxing. The process is described, for example, in U.S. Pat. Nos. 5,348,982 and 5,545,674, and suitable catalysts in U.S. Pat. No. 4,568,663, each of which is incorporated herein by reference.

The preferred GTL material from which the GTL base stock is derived is the high alpha waxy hydrocarbons produced in a FT synthesis process. By high alpha is meant an alpha of at least 0.85, preferably at least 0.9 and more preferably at least 0.92. As used herein, alpha refers to the Schultz-Flory kinetic alpha. The GTL base stock usually contains less than 1 wppm sulfur, nitrogen and metals.

The dewaxing step may be accomplished using one or more of solvent dewaxing, catalytic dewaxing or hydrodewaxing.

In solvent dewaxing, the isomerized wax product is contacted with chilled solvents such as acetone, methylethyl ketone (MEK), methylisobutyl ketone (MIBK), mixtures of MEK/MIBK and the like to precipitate the higher pour point material as a waxy solid which is then separated from the solvent-containing lube oil fraction. The solvent is then stripped out and dewaxed oil may be fractioned and, if necessary, be subjected to dehazing.

The waxy feed or Fischer-Tropsch wax comprises the waxy hydrocarbon fraction produced in a Fischer-Tropsch hydrocarbon synthesis reactor, which is liquid at the reaction conditions. It is referred to as wax, because it is solid at 24° C. (75° F.) and one atmosphere (101 kPa) pressure. It must contain sufficient waxy material boiling above 538° C. (1000° F.) to produce the heavy hydrocarbon composition of the invention. The waxy feed is typically dewaxed in one or more catalytic dewaxing steps in which the feed is contacted with hydrogen and a dewaxing catalyst under dewaxing conditions. The iso- to normal paraffin ratio is measured by GC for a composition containing molecules with up to 20 carbon atoms and a combination of GC with $^{13}$C-NMR for a composition containing molecules with 20 carbon atoms. Aromatics are determined by X-Ray Fluorescence (XRF), as described in ASTM D-2622. Sulfur is measured by XRF as per ASTM D-2622 and nitrogen by syringe/inlet oxidative combustion with chemiluminescence detection per ASTM D-4629.

The catalyst useful in the hydrodewaxing step comprises a solid acid component, a hydrogenation component and a binder. Illustrative, but nonlimiting examples of suitable catalyst components useful for hydrodewaxing include, for example, ZSM-23, ZSM-35, ZSM-48, ZSM-57, ZSM-22 also known as theta one or TON, and the silica aluminophosphates known as SAPO's (e.g., SAPO-11, 31 and 41), SSZ-32, zeolite beta, mordenite and rare earth ion exchanged ferrierite, preferably ZSM-48. Also useful are alumina and amorphous silica aluminas.

As in the case of many other zeolite catalysts, it may be desired to incorporate the solid acid component with a matrix material also known as a binder, which is resistant to the temperatures and other conditions employed in the dewaxing process herein. Such matrix materials include active and inactive materials and synthetic or naturally occurring zeolites as well as inorganic materials such as clays, silica and/or metal oxides e.g., alumina. The latter may be either naturally occurring or in the form of gelatinous precipitates, sols or gels including mixtures of silica and metal oxides. Use of a material in conjunction with the solid acid component, i.e., combined therewith, which is active, may enhance the conversion and/or selectivity of the catalyst herein. Inactive materials suitably serve as diluents to control the amount of conversion in a given process so that products can be obtained economically and orderly without employing other means for controlling the rate or reaction. Frequently, crystalline silicate materials have been incorporated into naturally occurring clays, e.g., bentonite and kaolin. These materials, i.e., clays, oxides, etc., function, in part, as binders for the catalyst. It is desirable to provide a catalyst having good crush strength since in a petroleum refinery the catalyst is often subject to rough handling which tends to break the catalyst down into powder-like materials which cause problems in processing.

Naturally occurring clays which can be composited with the solid acid component include the montmorillonite and kaolin families which include the sub-bentonites, and the kaolins commonly known as Dixie, McNamee, Georgia and Florida clays, or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the solid acid component can be composited with a porous matrix material such as silica-alumina, silica-magnesia, silica-zirconia, silica-thoria, silica-beryllia, silica-titania, as well as ternary compositions such as silica-alumina-thoria, silica-alumina-zirconia, silica-alumina-magnesia and silica-magnesia-zirconia. The matrix can be in the form of a cogel. Mixtures of these components can also be used. The relative proportions of finely divided solid acid component and inorganic oxide gel matrix vary widely with the crystalline silicate content ranging from about 1 to about 90 percent by weight, and more usually in the range of about 2 to about 80 percent by weight, of the composite.

The hydrogenation component will comprise at least one Group VIII metal component and preferably at least one noble Group VIII metal component, as in Pt and Pd. Noble metal concentrations will range from about 0.1 to 5 wt % of the metal, and more typically from about 0.2 to 1 wt %, based on the total catalyst weight. The Group VIII referred to herein refers to Group VIII as found in the Sargent-Welch Periodic Table of the Elements copyrighted in 1968 by the Sargent-Welch Scientific Company.

The preparation of ZSM-48 (ZSM-48 zeolites include EU-2, EU-11 and ZBM-30 which are structurally equivalent) is well known and is disclosed, for example, in U.S. Pat. Nos. 4,397,827; 4,585,747 and 5,075,269, and EP 0 142 317, the disclosures of which are incorporated herein by reference. Other hydrodewaxing catalysts useful in the practice of the invention, include any of the well known catalysts that dewax mostly by isomerization and not by cracking or hydrocracking. Zeolites comprising ten and twelve membered ring structures are useful as dewaxing catalysts, particularly when combined with a catalytic metal hydrogenating component. Hydrodewaxing reaction conditions employed to produce a hydrocarbon or heavy lubricant composition of the invention include a respective temperature, hydrogen partial pressure and space velocity broadly ranging from 232 to 399° C. (450 to 750° F.), 10 to 2,000 psig (69 to 13790 kPa), and 0.1 to 20 LHSV. These conditions will more generally range from 260 to 371° C. (500 to 700° F.), 100 to 1000 psig (690 to 6895 kPa) and 0.5 to 3.0 LHSV, with a pressure of from 200 to 700 psig (1379 to 4827 kPa) more typical.

The wax or waxy hydrocarbons produced by a Fischer-Tropsch reaction are hydrodewaxed using the treated catalyst of the invention to produce dewaxed products of reduced pour point comprising at least one of (i) a distillate fuel fraction, and (ii) a lubricant fraction. Typically, the hydrodewaxing reduces the pour point of the hydrodewaxed product to the desired specification to form one or more of (a) one or more distillate fuel stocks used for blending, and (b) one or more lubricant base stocks. The one or more lubricant base stocks will include a heavy lubricant base stock. By distillate fuel it is meant a hydrodewaxed hydrocarbon fraction, boiling somewhere in the range of from about $C_5$ up to about 288 to 388° C. (550 to 730° F.) and includes naphtha, diesel and jet fuel. In the context of the invention, the heavy fraction comprises a heavy lubricant oil fraction which, when hydrodewaxed, comprises a heavy lubricant base stock. The heavy lubricant base stock has an initial boiling point in the range of from about 454 to 538° C. (850 to 1000° F.), with an end boiling point above 538° C. (1000° F.), preferably above 566° C. (1050° F.). The initial and end boiling points values referred to herein are nominal and refer to the $T_5$ and $T_{95}$ cut points obtained by gas chromatograph distillation (GCD).

Distillate fuel and lubricant base stocks produced according to the invention are typically hydrofinished at mild conditions and dehazed. Hydrofinishing is a very mild, relatively cold hydrogenating process, which employs a catalyst, hydrogen and mild reaction conditions to remove trace amounts of heteroatom compounds, aromatics and olefins, to improve oxidation stability and color. Hydrofinishing reaction conditions include a temperature of from 150 to 350° C. (302 to 662° F.) and preferably from 150 to 250° C. (302 to 482° F.), a total pressure of from 400 to 3000 psig. (2859 to 20786 kPa), a liquid hourly space velocity ranging from 0.1 to 5 LHSV (hr.sup.-1) and preferably 0.5 to 3 hr.sup.-1. The hydrogen hourly treat gas rate will range from 250 to 10,000 is scf/B (44.5 to 1780 $m^3/m^3$). The catalyst will comprise a support component and at least one catalytic metal component of metal from Groups VIB (Mo, W, Cr), iron group (Ni, Co) or noble metals (Pt, Pd) of Group VIII. The Groups VIB and VIII referred to herein, refers to Groups VIB and VIII as found in the Sargent-Welch Periodic Table of the Elements copyrighted in 1968 by the Sargent-Welch Scientific Company. The metal or metals may be present from as little as 0.1 wt. % for noble metals to as high as 30 wt. % of the catalyst composition for non-noble metals. Preferred support materials are low in acid and include, for example, amorphous or crystalline metal oxides such as alumina, silica, silica alumina and ultra large pore crystalline materials known as mesoporous crystalline materials, of which MCM-41 is a preferred support component. The preparation and use of MCM-41 is known and disclosed, for example, in U.S. Pat. Nos. 5,098,684, 5,227,353 and 5,573,657.

The lubricant base stock is subjected to dehazing to improve its color, appearance and stability, preferably the base stock is a heavy lubricant base stock. Dehazing involves the following general steps, not all of which are needed in all instances for all waxy hazy lubricating oil base stock: optionally removing non-waxy particulate matter from the lubricating oil base stock by filtration, adsorption, centrifugation, membrane separation, distillation or some other standard separation technique; optionally adding a diluent to the lubricating oil stock; holding the (optionally diluted) lubricating oil stock at ambient conditions or preferably with slight cooling for a time sufficient for haze to form (i.e., incubation period); lowering the temperature below the filtration temperature to accelerate haze formation, then raising the temperature to the filtration temperature; filtering the haze causing wax from the incubated, and preferably cooled, hazy oil base stock using a filter characterized by a high surface area in pores accessible to the haze causing wax particles; recovering the dehazed oil as filtrate; removing the diluent from the filtrate if a diluent was used; optionally and preferably regenerating the wax saturated filter.

The wax filter media used to filter the haze causing wax in the base stock oil has a total material surface area of at least about 0.5 $m^2/g$ up to 100 $m^2/g$ accessible to the wax particles, and pores of from 0.2 to 50 microns, preferably 0.2 to 10 microns, more preferably 0.2 to 5 microns, most preferably 0.2 to 1 micron. "Pores" means the spacings between strands of fibers of the materials making up the filter material, e.g. the spacings between the fibers of the matted filter material. Typical wax haze particles are from less than about 5 microns to more typically about 0.2 microns in size. The use of this size media is what helps distinguish the composition of the present invention from compositions resulting from the use of typical state of the art adsorptive dehazing methods using adsorbents such as silica, alumina, fullers earth, activated carbon, bauxite and zeolite in which the surface area is present in pores of only about 0.001 micron and, therefore, not accessible to waxy haze particles.

The filter media will have dual functionality, both adsorption functionality and barrier, or sieving, functionality. Barrier filtration provides long on-time filtration before regeneration is required. Besides equipment utilization, barrier functionality provides high product yield and minimizes demand for regeneration utilities and byproducts. In addition, barrier filtration tends to balance fluid flow through various portions of the media that may differ in permeability due to heterogeneities from manufacturing of the media, heterogeneities from forming pleats for efficient packing in a cartridge, or heterogeneities due to deformation during use. To work in this way, it is advantageous that the pores of the filter media be small enough to trap/capture the wax particles so that the pressure drop across the filter due to particle trapping exceeds the pressure drop of the media itself.

However, barrier filtration alone has the disadvantage that it is difficult to completely remove the solid haze, due to the distribution of both wax particle sizes and media pore sizes. This is especially important in dehazing because of the small particle size and the fact that even low leakage can cause the filtrate to remain hazy. Adsorptive functionality can remove the particles that are difficult to completely capture by the barrier mechanism.

Media such as fiber metal, fiber glass, and aramid fiber all gave pressure drops due to plugging of at least about 2 psi, while the initial unplugged pressure drop was less than about 2 psi. Therefore, a medium with nominal pore size not more than about 10× larger than the nominal haze wax particle size is preferred.

The filtration/adsorption media can be of different physical forms. Sheets or mats of material can be employed. The sheets or mats are preferably sheets of random non woven fiber typically less than 0.5 cm in thickness, i.e., felt. Woven sheets with small enough pores between threads would also be acceptable, provided the sheets exhibited sufficiently high total material surface area and pores between fiber strands of sufficiently small a size. The fiber material can also be in the form of a tube or cylinder of any internal diameter and any length, the length preferably being greater than the internal diameter of the tube or cylinder. When sheets or mats are used they can be used as individual sheets or stacks of sheets. Individual or multiple sheets can be wound into a cylinder or tube or can be spirally wound around a hollow central core, each sheet being separated from any other sheet or sheet layer by a fluid permeably spacer sheet thereby forming a fluid passage chamber between each is sheet or sheet layer creating retentate and permeate spaces, as in the case of spiral wound membranes which are known in the art and operate under cross flow filtration conditions. In the case of tubes or cylinders of filter media or spiral wound membrane configured sheets the diluted waxy feed would be fed into the center of the tube or the core of the spiral wound element, the retentate would pass through the center of the tube while the permeate would pass into the permeate spaces and move perpendicular or crossflow to the flow of the feed/retentate through the center of the tube or cylinder or central core of a spiral wound element. This crossflow of permeate through the cylinder or tube or through the permeate space of the spiral wound element (crossflow referring to the direction of flow of the permeate with respect to the direction of flow of the feed/retentate through the cylinder or tube or the retentate space of the spiral wound element) permits operation of the process at a pressure drop of about 20 psi. Use of the spiral wound element would permit the employment of higher dilution concentrations than would flat fiber sheet filtration. Diluted feed viscosity of 3-4 $mm^2/s$ could be employed to result in a reduction in power dissipation and heating in the fluid due to pumping. This reduction in heating due to lower pumping pressures would have the advantage of avoiding the dissolution or melting of the haze particles in the feed which dissolved haze particles would otherwise pass through the filter and remain in the oil, thus resulting in a decrease in the efficiency of the dehazing process. Further, reducing the pumping forces employed further reduces the possibility that the wax haze particles are sheared and pass through the filter.

Filtration of an undiluted feed is preferably carried out a few degrees 2-15° C. (36-59° F.), preferably 5-10° C. (41-50° F.), below ambient temperature. Optionally, the feed is diluted to reduce the pressure drop across the filter and improve the filtration flux. Diluents can include naphtha, jet, diesel, kerosene, gas oil, gasoline and the like. For diluted feeds in which the diluent dissolves haze, the temperature at which haze is stable (HDT), the incubation temperature, and the filtration temperature are all lower than with undiluted feed.

The base stock being filtered will actually be hazy during the haze filtration step. The wax associated with ambient temperature haze is not effectively filtered from the base stock unless visible haze is present. To accelerate wax formation, the temperature of the base stock is lowered. If the base stock to be dehazed is not mixed with a diluent, then cooling the base stock to at least about 5° C. below the lowest anticipated ambient temperature or below the desired haze disappearance temperature (HDT) of the dehazed oil should be sufficient. Preferably the cooling can be to 10° C. or 15° C. below the lowest anticipated ambient temperature or the HDT of the dehazed oil. If the stock to be dehazed is mixed with a diluent the diluted stock can be cooled to at least about 10° C. below the lowest anticipated ambient temperature or the HDT target of the dehazed oil. In general, cooling to a temperature of about the cloud point of the oil to be dehazed is satisfactory.

The duration of such cooling, i.e., the haze incubation period, therefore, depends on the cooling temperature selected and the amount of haze precursor present in the oil stock to be dehazed. Thus, the time is that which is sufficient for visible haze to form. Such time can range from a few minutes to several hours, e.g., from 2 minutes to 3 hours, preferably about 5 minutes to 2 hours, more preferably about 10 minutes to 1 hour.

If a diluent was added to the haze oil, the diluent is removed from the now dehazed oil using any appropriate separation technique, e.g., stripping, distillation, membrane separation, etc.

The composition of the invention is characterized by a haze disappearance temperature of 20° C. (68° F.) or less. Haze disappearance temperature, hereinafter HDT, is the temperature at which haze is not visible and a petroleum product is judged to be clear and bright. At the HDT, essentially all molecules in a sample are liquid at thermodynamic equilibrium. The thermodynamic equilibrium can be measured by cooling a sample sufficiently to form haze, then heating the sample slowly and detecting the temperature at which no more haze is present. This must be done with a method that is at least as sensitive as the visual detection of light scattering in a sample performed as part of appearance and haze evaluation. Preferably, HDT is measured using an optical phase behavior unit. When the HDT of an oil is 20° C. or less, preferably 15° C. or less, the oil will remain clear and bright after being left standing at ambient conditions for an extended period of time, e.g., at least 14 days, preferably, at least 21 days, more preferably, at least 3 months, most preferably, at least 6 months.

It is speculated that the waxy molecules associated with this haze are typically present in very low concentrations, approximately 10 to 200 ppm by weight whereas the concentration of waxy molecules associated with traditionally measured cloud point is believed to be about 1000 ppm or higher, while the amount of waxy material associated with pour point of the oil is about 1 wt % (about 10,000 ppm). Further, not only is the amount of waxy material associated with haze substantially lower than the amounts associated with cloud point and pour point but the nature of the waxy material itself is different.

While not wanting to be bound by theory, it is believed that HDT is related to the amount and size of unbranched chain segments in a sample. Haze in a sample sufficiently free of inorganic and carbonaceous particulates, and water is caused by paraffinic molecules with long unbranched chain segments. The unbranched chain segments may be greater than 35 carbons. The temperature dependence of waxy haze precipitation can be understood in terms of the lengths of the unbranched chain segments of the paraffinic molecules and the total amount of paraffinnic molecules themselves. The molecules behave similarly to normal paraffins of approximately the length of their longest unbranched chain segments. When the concentration of such molecules exceeds the capacity of the fluid to dissolve them, the molecules precipitate of out solution, forming haze.

In the present invention the effective mitigation of ambient temperature haze is evidenced by the treated oil exhibiting a clear and bright appearance for at least 14 days, preferably 21 days or higher, more preferably 30 days or higher, still more preferably 60 days or higher or by exhibiting an NTU value of less than 2, preferably about 1.5 or lower, more preferably about 1.0 or lower for at least 14 days.

Clear and bright refers to a visual rating wherein the trained observer is able to see "haze or floc" formation in the oil. A rating of "hazy" would indicate lack of clarity due to particles evenly dispersed throughout the sample; often the particles are too small to detect as discrete, distinct objects. "Floc" would be due to much larger particles unevenly dispersed in the oil sample, frequently settling or concentrating in one section of the sample, such as at the bottom of the sample. The determination of whether a sample is clear and bright is a subjective judgment made by a trained observer of a sample under particular conditions. In the present instance, the conditions employed involved partially filling a 4 oz. Tall form bottle having a light path through the bottle of 1 to 1.5 inches and observing the sample under typical laboratory conditions with light approaching the back of the sample at about 10 to 20° off axis from the viewer. The light source is generally standard laboratory illumination which is typically fluorescent light. For long-term clear and bright stability the sample is stored in darkness at ambient temperatures. For most measurements "ambient temperature" was kept consistent by use of an incubator set at 68° F. (20° C.). The samples are stored and observed without agitation.

In the absence of haze, lubricant oils are generally clear and colorless. Thus, light will pass through an oil sample without absorption or scattering, giving a transmission of about 100%. Haze platelets formed by crystallizing paraffins, have a higher density and a different index of refraction and thus scatter light. Thus the transmission will decrease due to the light which is scattered. Since haze crystallites do not grow into macroscopic crystals, haze formation is a nucleation dominated process and thus the scattered intensity and the decrease in the transmitted intensity will be proportional to the concentration of haze as well as the path length through the lubricant. Thus, if a 0.1 mm path length with a given haziness decreases the intensity to 0.99 of the initial intensity, then a 1 mm path length will give 0.9910=0.904, and a 10 mm path length will decrease the intensity to 0.99100=0.37

The optical phase behavior unit used to measure HDT functions by irradiating a sample of product with light while cooling the sample to below room temperature, to a target temperature at about or below the cloud point of the sample. Light transmitted through the sample is measured and used to determine the delayed onset haze formation. Thereafter, the sample is heated to an elevated temperature, typically in the range of about 60° C. to 80° C. at a preselected control rate, and the light transmitted through the sample is measured and used to determine the HDT of the sample.

To determine the delayed onset haze formation of a dewaxed clear and bright lubricant base stock, reference is made to FIG. 1. A sample of the base stock is placed in cuvette 10 within cuvette holder 14. This can be achieved by manually placing a sample in the cuvette 10 or by flowing a stream, e.g., a slip stream from the dewaxing or dehazing process, into cuvette 10. When the sample is placed in the cuvette, it is important that it had been maintained under conditions sufficient to prevent any nucleation of haze-forming constituents. Thus, the sample at the time of placement in cuvette should have been at an elevated temperature in the range of about 80° C. to 120° C. for about 10 to 30 minutes. Optionally, but preferably, after placing the sample in cuvette 10, the sample is heated by heater 20 to about 90° C. for about 20 minutes to assure denucleation of any haze-forming constituents. The denucleation of haze-forming constituents may be determined by any convenient means, such as, measuring the light transmission through the sample. The temperature of the sample is then decreased to about 40° C. over about 10 minutes by circulation of chilled fluid through conduit 21 prior to the data-taking cooling ramp.

The sample also may be, and preferably is, subjected to conditions sufficient to ensure homogeneity of the sample. Such conditions can include shaking or stirring in cuvette 10. Alternatively, the sample can be heated and agitated in a separate container and then transferred to cuvette 10.

Next, the sample is cooled below room temperature to a target temperature at about or below the cloud point temperature of the sample. In general, the target temperature will be about −10° C. The cooling is conducted at a constant rate generally in the range of about 1 to 0.1°/minute, preferably at a 0.5°/minute.

While the sample is being cooled to the target temperature, light is continuously emitted into the sample by fiber optic cable 16, and the transmitted light is received by fiber optic cable 17 and is processed by programmable logic controller 18.

Among other functions, controller 18 is programmed to convert the raw data of transmitted intensity versus time (I raw (t)) to intensity versus temperature (I raw (T)). The intensity is then normalized to the intensity at the beginning of the run when no haze is present ($I(T)=I\ raw\ (T)/I_O$). The difference between this and unity is a measure of the scattered intensity and the amount of haze ($H(T)=1-I(T)$). As the temperature of the sample is reduced, H(T) will increase from zero to a threshold value, $H_t$ The temperature where $H(T)=H_t$ is $T_{haze}$.

To determine the maximum temperature at which haze may appear in the sample, the temperature ramp is reversed, and the sample is heated preferably at a fixed rate which optionally may be the same rate as the cooling rate while the light transmitted through the sample is monitored. The point at which H(T) decreases to the baseline or an extrapolation of the fastest falling portion of H(T) to the baseline is considered to be the haze disappearance temperature. The haze disappearance temperature represents the equilibrium disappearance temperature for the haze and is the temperature above which haze will never form. The haze disappearance temperature of the heavy lubricant base stock composition of the invention is 20° C. (68° F.) or less, preferably 15° C. (59° F.) or less.

The fully formulated heavy lubricant or heavy lubricating oil compositions are prepared by adding to the heavy lubricant base oil an effective amount of at least one additive or, more typically, an additive package containing more than one additive. Base oils comprise at least one base stock. Illustrative, but non-limiting examples of such additives include one or more of a detergent, a dispersant, an antioxidant, an antiwear additive, an extreme pressure additive, a pour point depressant, a VI improver, a friction modifier, a demulsifier, an antioxidant, an antifoamant, a corrosion inhibitor, and a seal swell control additive.

The following non-limiting examples are provided to illustrate the invention.

EXAMPLES 1-4

A GTL base stock was dewaxed under dewaxing conditions using a ZSM-48 dewaxing catalyst. The dewaxed oil was heated to a temperature of about 55° C. (131° F.) and diluted with 33 wt % of an 80% n-heptane, 20% n-octane solvent. The diluted oil was cooled to a temperature of about −3.9° C. (25° F.) and held at this temperature for about 3 hours. The oil was then filtered through a polyvinylidene defluoride filter having a total surface area of about 0.5 $m^2/g$ and a pore size of 0.45 microns at a flow rate of 0.05 gal/min*ft$^2$. The filtered oil was left standing at ambient conditions for a period of 6 months. The filtered base stock properties are disclosed in Table 1.

The HDT of the samples was measured using an optical phase behavior unit. All samples resulted in an HDT of about 18° C. The samples remained clear and bright after standing for a period of 6 months. Even after the 6 month period, the samples remained clear and bright. The cloud point was measured according to ASTM D5773.

NTU values were determined using a Hach Co. Model 2100 P Turbidimeter. The turbidity meter is a nephelometer that consists of a light source that illuminates the oil sample and a photoelectric cell that measures the intensity of light scattered at a 90° angle by the particles in the sample. A transmitted light detector also receives light that passes through the sample. The signal output (units in nephelometric turbidity units or NTUs) of the turbidimeter is a ratio of the two detectors. The instrument met US-EPA design criteria as specified in US-EPA method 180.1. NTU values were determined at a temperature of 25° C.

TABLE 1

| | Alpha, α | Kinematic Viscosity (KV) @100° C. | Viscosity Index | Cloud Point (° C.) | HDT (° C.) | NTU at 25° C. | Appearance |
|---|---|---|---|---|---|---|---|
| 1 | 0.93 | 16.18 | 152.3 | −9 | 18 | 0.3 | Clear and Bright |
| 2 | 0.94 | 17.66 | 146.7 | −12.1 | 18 | 0.2 | Clear and Bright |
| 3 | 0.93 | 16.87 | 144.2 | −18 | 18 | 0.1 | Clear and Bright |
| 4 | 0.92 | 16.62 | 150.6 | −8.6 | 18 | 0.2 | Clear and Bright |

COMPARATIVE EXAMPLES 5-7

In the following comparative examples 5-7, a GTL base stock was dewaxed under dewaxing conditions using a ZSM-48 dewaxing catalyst. The oil was not filtered.

The HDT of the samples was measured using an optical phase behavior unit. The dewaxed oil properties are provided in Table 2. The cloud point was measured according to ASTM D5773.

TABLE 2

| | Alpha, α | Kinematic Viscosity (KV) @100° C. | Viscosity Index | Cloud Point (° C.) | HDT (° C.) | Appearance |
|---|---|---|---|---|---|---|
| 5 | 0.93 | 18.6 | 149.1 | −5° C. | 53.6 | Hazy |
| 6 | 0.93 | 14.3 | 155.3 | 7° C. | 30-50 | Hazy |
| 7 | 0.93 | 15.7 | 148.2 | −1.7° C. | 25.2 | Hazy |

EXAMPLES 8-9

In the following examples, a 13 cSt petroleum wax isomerate was used. The petroleum wax isomerate contained 15 ppm of BHT (3,5 di-t-butyl 4 hydroxytoluene) to prevent oxidation. The petroleum wax isomerate of example 8 was placed in a cold room at about 4° C. (39° F.) overnight. The wax isomerate was then filtered using a 0.45 micron polyvinylidene defluoride filter at a temperature of about 2° C. (36° F.) and at a flux of 0.04 gal/min ft$^2$. The petroleum wax isomerate of example 9 was stored at ambient conditions and was not filtered. The cloud point of the samples was measured according to ASTM D5773.

As is demonstrated in Table 3, the filtered base stock had an HDT of 10.1° C. and an NTU at 20° C. of 0.35 while the unfiltered base stock had an HDT of 23.8° C. and an NTU at 20° C. of 1.0. NTU is not a good indicator of whether an oil will remain haze free. Although the unfiltered base stock had an NTU of 1.0, the sample developed haze after standing at ambient temperature for an extended period of time, i.e., about 6 months. As will be noted the HDT value of this sample was greater than 20° C. An appearance could not be measured in the filtered sample of example 8 because the amount of filtered oil remaining was insufficient. It is believed that the filtered oil would remain haze free because its HDT was less than 20° C.

TABLE 3

| | Kinematic Viscosity @100° C. | Viscosity Index | Cloud Point (° C.) | HDT (° C.) | NTU* @20° C. | Appearance |
|---|---|---|---|---|---|---|
| Example 8 | 13.39 | NA | −1.2° C. | 10.1 | 0.35 | NA |
| Comparative Example 9 | 13.34 | 142.4 | 5° C. | 23.8 | 1.0 | Hazy |

*US-EPA Method 180.1.

COMPARATIVE EXAMPLES 10 and 11

A GTL base stock was filtered using a fixed bed adsorption unit containing adsorbent materials according to U.S. Pat. No. 6,579,441 to Biscardi et al. The adsorbents used were Na-13X zeolite and Al-ZSM$_5$ zeolite. The conditions used in Example 10 were as follows: filtration temperature 28° C. (82° F.), undiluted sample, particle size was about 0.7 mm, the residence time was 40 minutes and the flux was 0.7 gpm/ft$^2$. The conditions used in Example 11 were as follows: filtration temperature 78° C. (172° F.), the particle size was about 1.0 mm, the residence time was 210 minutes and the flux was 0.14 gpm/ft$^2$. The column back pressure was generally less than 50 psi.

TABLE 4

| | Filter Media | Kinematic Viscosity (KV) @100° C. | HDT (° C.) | NTU** @20° C. | Appearance |
|---|---|---|---|---|---|
| 10 | Na-13X Zeolite | 14.3 | 31.3 | 1.6 | Hazy |
| 11 | Al-ZSM5 zeolite | 14.3 | 49.0 | 0.4 | Haze |

**Light source was 860 nm+ (infrared) using a Hach Co. Model 2100 P Turbidimeter. The use of a 860 nm+ filter and an EPA filter according to US-EPA Method 180.1 does not change the results obtain. The Hach Co. Model 2100 P Turbidimeter was calibrated using colorless NTU standards for both types of filters.

As will be noted, despite having an NTU value of <2, the samples developed haze after standing at ambient temperature. The HDT values of both samples were >20° C. As is demonstrated by these examples, NTU is not an appropriate measure of whether haze will develop and furthermore the adsorbents disclosed by Biscardi cannot effectively remove haze to achieve a sample that remains clear and bright for at least 6 months.

COMPARATIVE EXAMPLE 12

GTL heavy lubricant base stock samples were prepared by processing GTL wax at various conversion severities over a hydrodewaxing catalyst. The samples prepared were a full range of 950° F.-1300° F. (and higher) boiling point and a fractionated boiling range of 950° F. to 1100° F. All samples produced had a kinematic viscosity of greater than 10 cSt at 100° C. Turbidity was measured using a Hach Co. Model 2100 P Turbidimeter at 20° C. The haze disappearance temperature (HDT) of the samples was measured using an optical phase behavior unit. Results are shown in FIG. 2.

Figure 2:
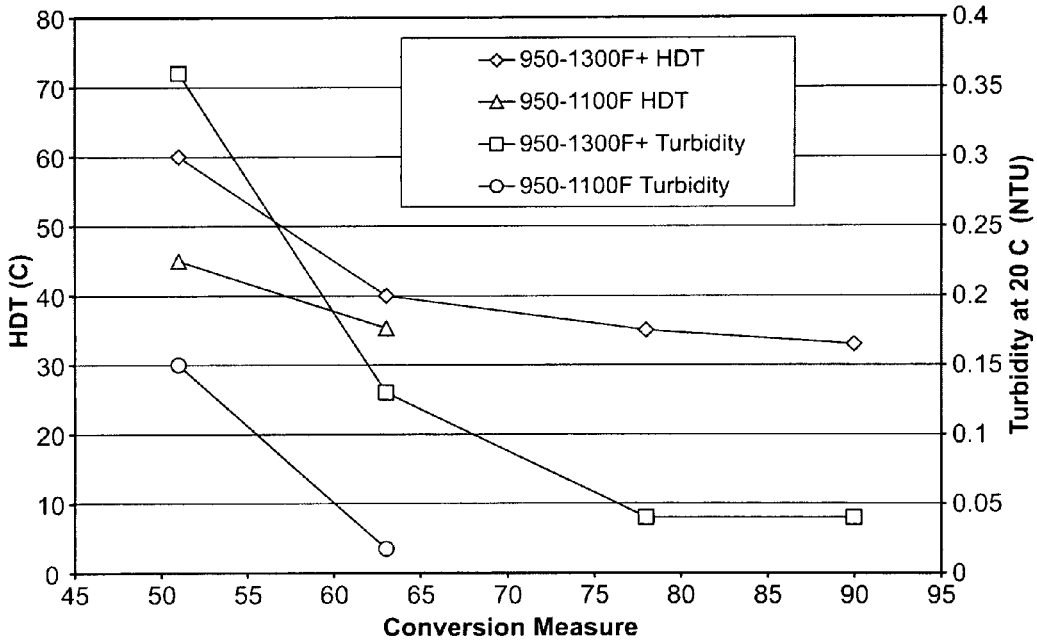
FIG. 2 is a plot of conversion, haze disappearance temperature and turbidity.
Figure 3:
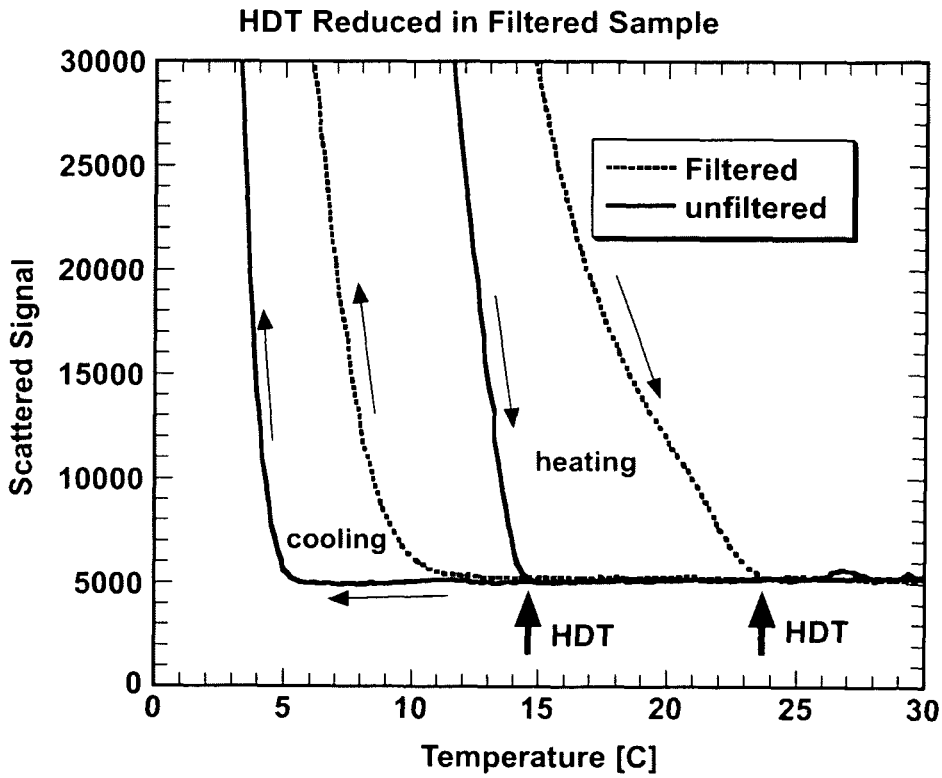
FIG. 3 is a plot illustrating an important aspect of the invention.

As will be noted from FIG. 2, increasing the conversion severity to create more isomerized product helped lower the extent or intensity of haze. However, the increased severity resulted in a reduced yield of the desired product. Restricting the distillation range to lower boiling molecular weight fractions was sufficient to lower the extent or intensity of haze but this was at the expense of much of the 1000° F.+ range lube base stock.

COMPARATIVE EXAMPLE 13

A 950° F.$^+$ Fischer Tropsch fraction derived from a Fischer Tropsch wax having a kinematic viscosity at 100° C. of greater than 12 cSt was contacted with a pseudo-boehmite alumina extrudate, as disclosed in U.S. Pat. No. 6,579,441, having a cross-sectional diameter of 0.056 inches. The 950° F.$^+$ Fischer Tropsch fraction had an HDT of 58° C. prior to filtration.

A ratio of 3 grams of oil to 1 gram alumina was used. The contact time between the oil and the absorbent was 1.5 hours, which is equivalent to 2 $hr^{-1}$ WHSV. The oil and adsorbent mixture was not stirred. The experiment was run at ambient pressure and at a temperature of about 47° C. After 1.5 hours, the oil was vacuumed filtered and the filtered oil tested in the Optical Phase Behavior Unit (OPBU) to determine the HDT (° C.). The filtered oil had an HDT of 50° C.

The same experiment was run except that the oil and adsorbent mixture was stirred continuously for a contact period of 1.5 hours. The filtered oil had an HDT of 50° C.

The use of a pseudo-boehmite alumina extrudate, as disclosed in U.S. Pat. No. 6,579,441, did not result in an HDT of less than 20° C.

Referring now to FIG. 5, a graphical plot of the results obtained with an optical phase behavior unit on a dewaxed GTL base stock (labeled Feed in the plot) and a dewaxed and dehazed GTL base stock (labeled Filtered in the plot). The base stock used was clear and bright and had a VI of 155, a Kv at 40° C. of 94.98 cSt and at 100° C. of 14.3 cSt. The dewaxed and dehazed GTL base stock was obtained by diluting the feed to 33 wt % paraffinic naphtha, followed by cooling overnight to 7.2° C. and then to 0° C. over about 3 hours. The cooled material was then filtered through 4 layers of fibrillated aramid of 1 micron nominal pore size at a rate of 0.05 gal/min. $ft^2$, for 10 minutes. Finally, the naphtha was removed by distillation.

Importantly, as illustrated in FIG. 5, a heavy lubricant base stock can be produced and the haze-forming tendency can be measured and controlled to provide a base stock that will not form any haze above a preselected temperature.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

It is also understood that the following claims are intended to cover all of the generic and specific features of the invention herein described and all statements of the scope of the invention, which as a matter of language, might be said to fall therebetween.

What is claimed is:

1. A heavy hydrocarbon composition derived from a Fischer-Tropsch synthesis process useful as a heavy lubricant oil base stock, the composition having been dehazed by cold filtration using filter media having pores from 0.2 to 5 microns, the cold filtered composition further characterized by at least greater than 50 wt % iso-paraffinic molecules;

a distribution of molecules wherein at least 75 wt % of the molecules have a carbon number greater than $C_{25}$;

10wt % of the total base oil boiling above 537° C.(1000° F.);

a kinematic viscosity at 100° C. of at least 8 cSt; and a haze disappearance temperature of 20°C. (68°F.) or less, the cold filtration having been conducted at a temperature of at least about 5°C. below the haze disappearance temperature.

2. The composition of claim 1 having a carbon number of at least 50% greater than $C_{25}$.

3. The composition of claims 1 or 2,wherein 50 wt % of the total base oil boils above 537° C. (1000° F.).

4. The composition of claims 1 or 2 having a kinematic viscosity at 100° C. of at least 12 cSt.

5. The composition of claims 1 or 2, wherein the haze disappearance temperature is 15° C. (68° F.) or less.

6. A heavy lubricant composition comprising the composition of claim 1 and at least one additive.

7. The composition of claim 3 having a kinematic viscosity at 100° C. of at least 12 cSt.

8. The composition of claim 3, wherein the haze disappearance temperature is 15° C. (68° F.) or less.

9. The composition of claim 4, wherein the haze disappearance temperature is 15° C. (68° F.) or less.

10. The composition of claim 7, wherein the haze disappearance temperature is 15° C. (68° F.) or less.

* * * * *